US005660550A

United States Patent [19]

Roche

[11] Patent Number: 5,660,550

[45] Date of Patent: Aug. 26, 1997

[54] SOCCER KICK TRAINING DEVICE

[76] Inventor: Mortimer P. Roche, 8516 Blounts La., Fulton, Md. 20759

[21] Appl. No.: 633,892

[22] Filed: Apr. 17, 1996

[51] Int. Cl.[6] ..... A63B 69/00

[52] U.S. Cl. ..... 473/427

[58] Field of Search ..... 434/251; 273/411; 482/54, 909

[56] References Cited

U.S. PATENT DOCUMENTS

| | | | |
|---|---|---|---|
| 3,090,621 | 5/1963 | Heimers et al. . | |
| 3,627,313 | 12/1971 | Schonfeld | 482/909 |
| 3,711,090 | 1/1973 | Fiedler | 482/54 |
| 4,477,083 | 10/1984 | Sowards | 273/411 |
| 4,635,928 | 1/1987 | Ogden et al. | 482/54 |
| 4,641,834 | 2/1987 | Heged et al. | 273/411 |
| 4,720,095 | 1/1988 | Sowards | 273/411 |
| 4,898,378 | 2/1990 | Edwards et al. | 482/54 |
| 4,911,443 | 3/1990 | Foster | 273/411 |
| 5,205,800 | 4/1993 | Grant | 482/54 |
| 5,358,258 | 10/1994 | Killion . | |
| 5,385,519 | 1/1995 | Hsu et al. . | |
| 5,401,034 | 3/1995 | Mallinger . | |
| 5,435,572 | 7/1995 | Covel | 273/411 |

FOREIGN PATENT DOCUMENTS

| | | | |
|---|---|---|---|
| 810250 | 3/1981 | U.S.S.R. | 434/251 |

*Primary Examiner*—Paul Hirsch
*Attorney, Agent, or Firm*—Terrance L. Siemens

[57] ABSTRACT

A soccer kicking practice device. The device has a movable platform or running surface, such as a motorized treadmill, for forcing the user to run while practicing, and a movable kick target, both the movable platform and movable target mounted on a stationary base. Preferably, the practice device has a hand rail and a body harness for steadying and retaining the user. Elevating apparatus enables the practice device to elevate its front end or its rear end, to simulate uphill and downhill inclination of terrain. Controls enable speed of the treadmill and of the kick target to be adjusted, and the elevating apparatus to operate as desired. Optionally, the treadmill is lined with artificial turf. Automated scoring apparatus is optionally provided for recording and totalizing the number of kicks.

11 Claims, 2 Drawing Sheets

SOCCER KICK TRAINING DEVICE

BACKGROUND OF THE INVENTION

1. Field of the Invention

The present invention relates to a training aid for providing kicking practice under dynamic conditions. The device combines a stationary running track device having a movable track surface, such as an endless belt, on which the user stands. Operation of the belt requires the user to run in place. A moving foot target is mounted on the device in close proximity to the endless belt. The user attempts to kick the target while running in place on the belt. This aid produces realistic practice conditions with respect to running, balance, and like aspects of the real game, but occupies limited space.

2. Description of the Prior Art

Evolution of athletic training devices continues in the direction of ever greater specialization in that devices are being designed for more and more different athletic activities. Athletic activities and sports formerly lacking specialized training devices are now being provided with new training devices designed exclusively for developing skills and muscular development particular to a single given area of endeavor.

A case in point is that of running. While it may seem that requirements for providing facilities for running are minimal, the requirement being merely some open space, additional factors complicate the picture. In some cases, open space is at a premium, such as in built up cities. While sidewalks and the like may be available, running on such a hard surface may induce injury such as shin splints. The weather may cause it to be impossible or extremely unpleasant to run outdoors. Still other considerations, such as personal security, may play a role in deciding whether to run outdoors.

Automated equipment for running in place has been developed to answer these objections. A further ability of automated equipment is that effort can be objectively measured and annunciated.

The same problems beset soccer players who desire to increase their ball handling skills. A further complication for soccer players is that when a ball is kicked, it is projected away from the kicker, who must then retrieve the ball to practice a subsequent kick. In the absence of cooperative assistants, this becomes a time consuming and tiring aspect of practice.

Imposing further difficulties to practice is the issue of realism. It is highly desirable that kicking practice be performed while running, which is a realistic condition of an actual soccer game. Critical balance and timing skills are developed when kicking when simultaneously running.

Therefore, it will be seen that there exists a need for a practice device which duplicates aspects of play while retaining a kicking target in close proximity to the user.

A moving platform mounted on a stationary frame, for running in place, is well known in the art of athletic aids. An example is seen in U.S. Pat. No. 5,385,519, issued to Chi-Hsueh Hsu et al. on Jan. 31, 1995. This device employs a motorized endless belt and provides various controls, such as a speed control for varying belt rotational speed. Unlike the present invention, no apparatus for kicking practice is incorporated or even suggested. By contrast, the present invention provides plural kicking targets, enables these targets to move relative to the user to develop timing skills, and spots the targets in proximity to the moving platform or belt.

Prior art devices for assisting in kicking practice are rudimentary. Balls for kicking and tethering apparatus for maintaining the ball in proximity to the user are seen in U.S. Pat. No. 5,358,258, issued to Darryl Killion on Oct. 25, 1994, and U.S. Pat. No. 5,401,034, issued to David P. Mallinger on Mar. 28, 1995. Both devices are in essence tethers. The former attaches to the user's waist, and the latter is hand held. Unlike the present invention, no provision is made for spotting the ball in a preferred location or for controlling plural balls. Obviously, there is no movable platform or belt for enabling running in place, as is found in the present invention.

None of the above inventions and patents, taken either singly or in combination, is seen to describe the instant invention as claimed.

SUMMARY OF THE INVENTION

The present invention provides a practice device for soccer style kicking by combining a moving platform and a moving kicking target. The moving platform may be an otherwise conventional treadmill modified to incorporate a suitable kicking target. The target moves through a predetermined path on the practice device and periodically is located proximate the moving platform. The user is obliged both to run in place while kicking the ball. These simultaneously performed actions provide an important benefit of the device, since the combination forces the user to develop skills which are crucial to successful performance under real game conditions.

A particular type of practice which is possible in the present invention is that of running, planting one foot, and kicking, performed in successive steps. The user runs on the treadmill, plants a foot on a stationary member of the device, and then kicks the moving target.

A treadmill alone can provide conditioning, but cannot also oblige the user to develop balance and timing skills required to kick a ball accurately while running. A tether alone cannot force the discipline upon the user which discipline is imposed by being forced to kick on the run. It is theoretically possible to employ a tether device while running, but the speed is entirely under control of the user. Therefore, there is an unrealistic aspect of control which passes to the user. By contrast, the combination of the present invention imposes an external, arbitrary pace of running and of timing the kick. This combination enhances development of physical skills required for successful real game play.

The invention includes body supports for steadying a user and limiting injurious falls. The supports include a hand rail which is attached to the frame of the device. Optionally, a harness and tether may be employed to catch the user should he or she stumble during practice.

Controls are provided for varying practice conditions. One control is a speed control for varying speed of the moving platform relative to the platform, and a second control varies speed of the kicking target. These features enable continuous challenge and progressive development of skills at ever increasing levels of difficulty.

Optionally, the device has apparatus for selectively elevating opposing ends of the device, or at least of the moving platform. This condition simulates inclined ground.

In a further option, the moving platform is covered with artificial turf, for simulating the turf of a soccer field. This avoids development of subconscious dependency upon artificially solid footing while running.

In another option, apparatus for recording and assessing results of the practice may be provided. In particular, the number of hits and misses of kicks to the target may be recorded and related to probable theoretical outcomes in a real game situation. Therefore, a score or similar statistical parameter of play may be inferred and totalized for concurrent or subsequent annunciation.

Accordingly, it is a principal object of the invention to provide a device for kicking practice which provides a moving platform disposed proximate a kicking target.

It is another object of the invention to move the kicking target relative to the position of the user.

It is still another object of the invention to adjust speed of the kicking target.

It is a further object of the invention to provide body supports for steadying a user during practice and for limiting falls.

Still another object of the invention is to enable adjustable positioning of a body support to enable both right sided and left sided practice.

An additional object of the invention is to enable the practice surface to simulate inclined ground.

It is again an object of the invention to enable the practice surface to simulate turf.

Yet another object of the invention is to control speed of the practice surface as it moves on the novel device.

Still another object of the invention is to enable automated recording and assessment of results while practicing.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
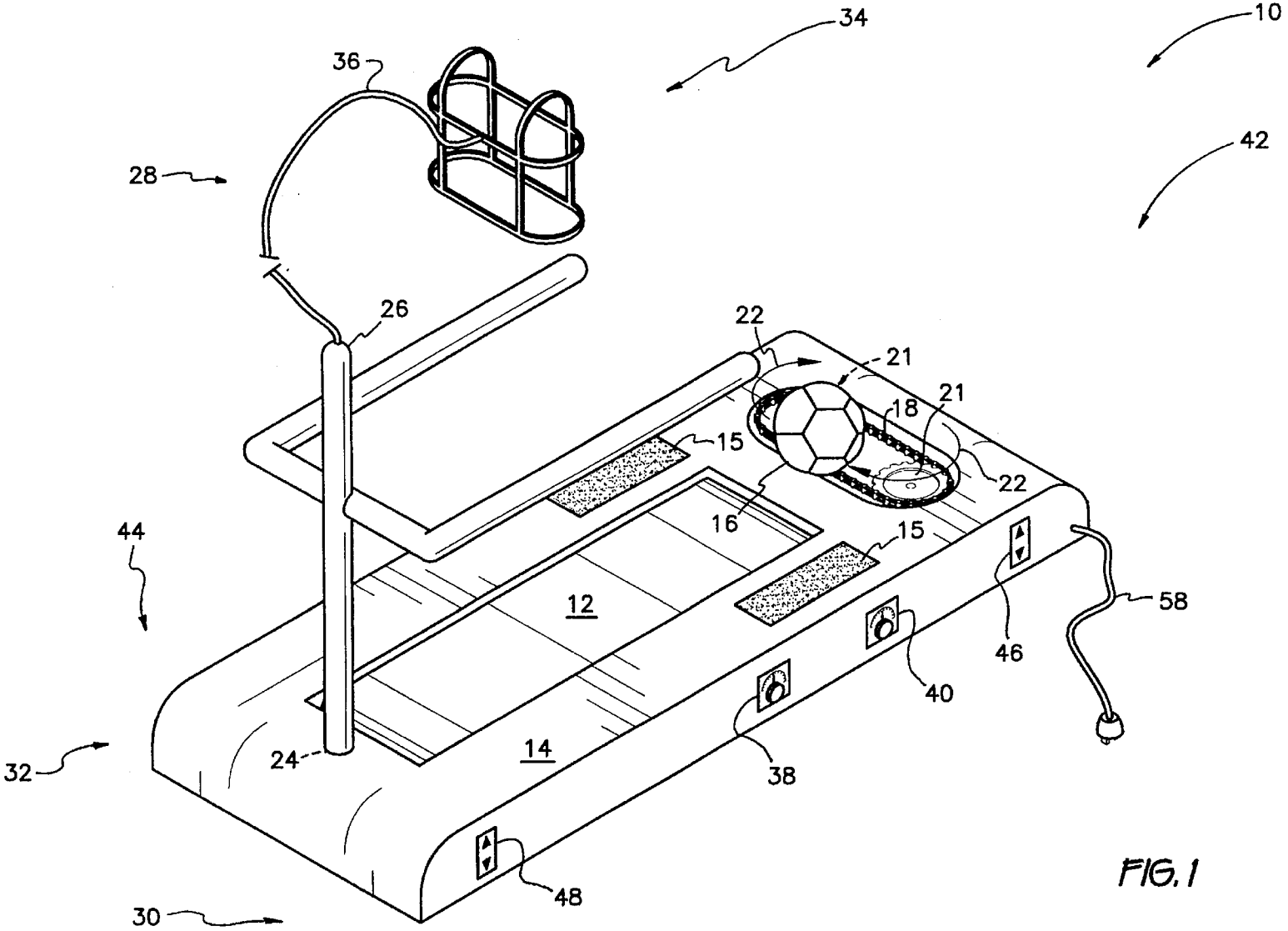
FIG. 1 is a perspective view of the invention, with some components omitted for clarity.

FIG. 1 shows the novel kicking practice device 10 to comprise a treadmill 12 mounted on a stationary base 14 in conventional fashion, and a kicking target 16 mounted on base 14 proximate treadmill 12. Treadmill 12 is representative of any suitable movable platform which may be movably or rotatably mounted upon base 14, so that a user must run in order to maintain proximity to kicking target 16. Kicking target 16 preferably simulates a soccer ball, and is mounted to base 14 within kicking reach of treadmill 12.

Kicking target 16 is mounted on a chain 18 by a stiff spring 20 (see FIG. 2) secured to chain 18. Target 16 usually projects upwardly from base 14 by virtue of orientation of chain 18. Chain 18 is part of actuation apparatus for automatically moving target 16 in a repeating, predetermined path, as indicated by arrows 22. This path is a closed loop forming an oval in the present example. Cyclic travel of target 16 through this path as treadmill 12 moves forces the user to time his or her kicks appropriately, as would be required in an actual soccer game situation.

Chain 18 is sturdy enough to withstand kicking of target 16, and is supported on base 14 so as not to be displaced or damaged by kicking practice. For example, chain 18 is carried on large gears 21 which are sturdily mounted on base 14.

Base 14 has a receptacle 24 for accepting the upright mast 26 of a handrail 28 anchored within and projecting above base 14. Handrail 28 is employed for support while performing a kicking maneuver in which the user runs on treadmill 12, jumps from treadmill 12 and plants his or her foot on a foot grip pad 15 located on stationary base 14, and then kicks target 16 with full weight bearing on pad 15. Handrail 28 pivots within receptacle 24 to enable unobstructed access when the user jumps onto pad 15.

Optionally, a body harness 34 for encircling the body of the user and a tether 36 connecting harness 34 to mast 26 or to handrail 28 are provided to prevent a user from striking the ground should he or she fall during practice.

The depiction of FIG. 1 also illustrates controls for controlling certain motorized features of the invention. Speed of treadmill 12 and speed of target 16 as it moves through its path are controlled by switches 38 and 40. Also, elevation of either front end 42 or rear end 44 is controlled by switches 46 and 48.

Figure 2:
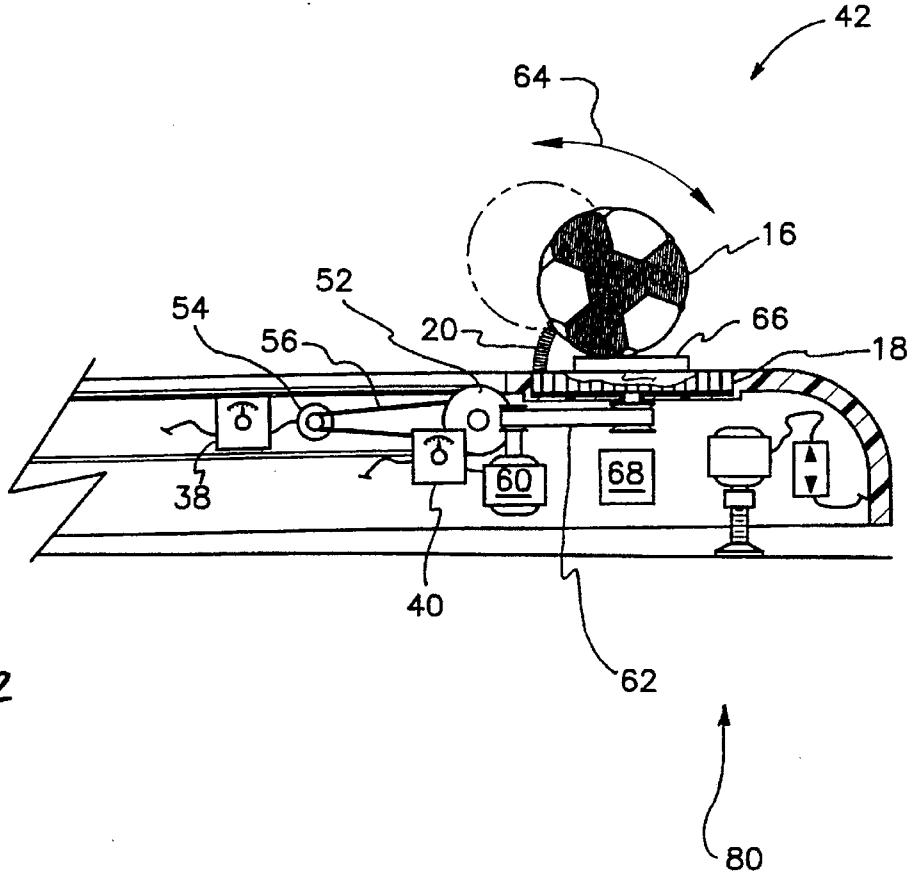
FIG. 2 is a diagrammatic, side elevational view of the invention, with the side housing omitted to reveal internal detail.

Turning now to FIG. 2, operation of practice device 10 is explained with reference to internal components. Treadmill 12 is shown representatively on rollers 50, 52, although it will be understood that conventional construction is employed in providing treadmill 12, and some components are omitted for brevity. Treadmill 12 is driven by motor 54 through a suitable gear reduction drive, such as pulley arrangement 56.

Motor 54 is adjustably controlled by switch 38. Switch 38 may be a variable frequency controller, or may be a multi-position switch selectively energizing different windings (not separately shown) of motor 54, depending upon whether continuous speed variation is desired, or whether speed is to be varied in discrete steps.

A variable frequency controller would apply if power for motor 54 were supplied by conventional household AC power, which would be connected by plug and cord 58 (see FIG. 1). Of course, DC power may be employed if a battery (not shown) were provided. In this case, switch 38 would be a variable voltage switch.

Chain 18 is driven by a motor 60 through an appropriate drive, such as pulley arrangement 62. Switch 40 is arranged in a manner similar to that of switch 38.

Spring 20 attaching target 16 to practice device 10 is shown in this Figure. Spring 20 is strong and durable, but capable of inclining as shown, so that target 16 can move from the upright position (shown in broken line) to the displaced position shown in solid lines. The range of motion of target 16 is indicated by arrow 64.

It will be noted that at its displaced position, target 16 contacts a switch 66. Switch 66 completes a signalling circuit responsive to contact, and a signal is transmitted to a recording and totalizing device, such as microprocessor 68. Microprocessor 68 records and totalizes the number of kicks of sufficient force to cause target 16 to operate switch 66. Results may be annunciated in any suitable manner, such as a visual display or a buzzer (neither shown).

FIG. 2 illustrates another feature of the invention for further varying practice conditions. Either front or rear end 42, 44 may be elevated relative to a supporting environmental horizontal surface, such as a floor, so as to simulate inclined terrain. Elevating apparatus 70, seen at the left of this Figure, comprises a motor 72 drivably connected to a threaded shaft or screw 74. An enlarged foot 76 terminates screw 74, and makes contact with the floor F. A threaded block 78 is solidly fixed to base 14, so that rotation of screw 74 causes screw 74 to move upwardly or downwardly relative to block 78. Reversing switch 48 reversibly controls motor 72. A functionally identical assembly is provided at 80 for elevating and lowering front end 42 of practice device 10.

Figure 3:
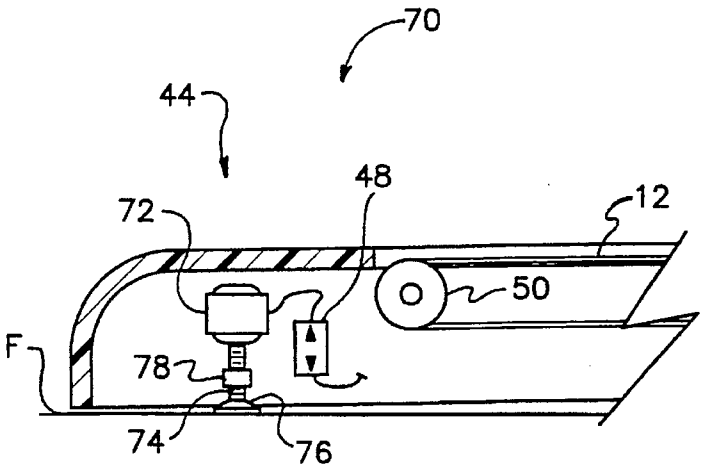
FIG. 3 is a side elevational detail view of the belt and roller, taken from the left of FIG. 2.
Figure 3:
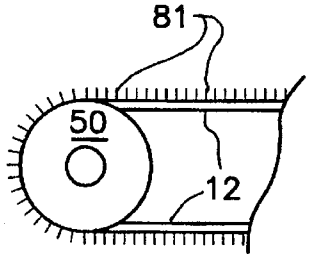

Optionally, treadmill 12 is lined with artificial turf 81, as seen in FIG. 3. Artificial turf 81 is disposed upon the contact surface of treadmill 12, that being the surface upwardly exposed in FIG. 1 and subject to direct contact by the user's feet. Artificial turf provides a slightly less secure surface than that typically provided in treadmills for endurance conditioning. Therefore, the user is forced to increase concentration on footing while simultaneously running and kicking.

It is to be understood that the present invention is not limited to the embodiments described above, but encompasses any and all embodiments within the scope of the following claims.

I claim:

1. A kicking practice device for developing skills related to simultaneous running and kicking, said practice device comprising:

a stationary base;

a movable platform disposed upon said stationary base, and a motor operably connected to said movable platform for moving said platform;

a kicking target projecting from said stationary base within kicking reach of said movable platform; and powered actuation means for automatically moving said kicking target on said stationary base in a repeating predetermined path.

2. The kicking practice device according to claim 1, further comprising a hand rail anchored within and projecting above said stationary base.

3. The kicking practice device according to claim 2, said stationary base having a right side and a left side, said practice device further comprising means for mounting said hand rail selectively on said right side and said left side of said stationary base.

4. The kicking practice device according to claim 1, further comprising a mast projecting upwardly from said stationary base, a harness for encircling the body of a user, and a tether connecting said harness to said mast, whereby a user is prevented from striking the ground when falling during practice.

5. The kicking practice device according to claim 1, further comprising scoring means for recording and totalizing kicks striking said kicking target.

6. The kicking practice device according to claim 5, further comprising elevating means for selectively elevating one end of said movable platform relative to a supporting environmental horizontal surface, whereby said practice device simulates inclined terrain.

7. The kicking practice device according to claim 1, further comprising means for varying operating speed of said movable platform.

8. The kicking practice device according to claim 1, further comprising actuation means for varying speed of said kicking target, said actuation means comprising a support member movably mounted on said kicking practice device, for supporting said target, a kicking target motor, drive apparatus for driving said support member by said kicking target motor, and a variable speed controller for controlling said kicking target motor.

9. The kicking practice device according to claim 1, said movable platform having a contact surface bearing artificial turf, whereby said movable platform simulates turf.

10. A kicking practice device for developing skills related to simultaneous running and kicking, said practice device comprising:

a stationary base;

a movable platform disposed upon said stationary base, and a motor operably connected to said movable platform for moving said platform;

a kicking target projecting from said stationary base within kicking reach of said movable platform;

powered actuation means for automatically moving said kicking target on said stationary base in a repeating predetermined path, said actuation means comprising a chain forming a closed loop, and means for movably supporting said chain on said stationary base.

11. A kicking practice device for developing skills related to simultaneous running and kicking, said practice device comprising:

a stationary base having a right side and a left side;

a movable platform disposed upon and movable relative said stationary base, a motor operably connected to said movable platform for moving said platform, and means for varying operating speed of said movable platform, said movable platform having a contact surface bearing artificial turf, whereby said movable platform simulates turf;

a kicking target projecting from said stationary base within kicking reach of said movable platform, actuation means for automatically moving said kicking target on said stationary base in a repeating predetermined path, said actuation means comprising a chain forming a closed loop and having means for securing said kicking target to said chain, means for movably supporting said chain on said stationary base, and means for varying speed of said kicking target;

a hand rail anchored within and projecting above said stationary base, and means for mounting said hand rail selectively on said right side and said left side of said stationary base;

a harness for encircling the body of a user, and a tether connecting said harness to said hand rail, whereby a user is prevented from striking the ground when falling during practice;

scoring means for recording and totalizing kicks striking said kicking target; and elevating means for selectively elevating one end of said movable platform relative to a supporting environmental horizontal surface, whereby said practice device simulates inclined terrain.

* * * * *